United States Patent [19]

Takahashi

[11] 4,420,664

[45] Dec. 13, 1983

[54] DISPLAY TYPE PUSH BUTTON

[75] Inventor: Toshihiro Takahashi, Tsurugashima, Japan

[73] Assignee: Toko Kabushiki Kaisha, Tokyo, Japan

[21] Appl. No.: 460,049

[22] Filed: Jan. 21, 1983

[30] Foreign Application Priority Data

Jan. 25, 1982 [JP] Japan ..... 57-8322[U]

[51] Int. Cl.[3] ..... H01H 9/16

[52] U.S. Cl. ..... 200/308

[58] Field of Search ..... 200/308, 309

[56] References Cited

U.S. PATENT DOCUMENTS 3,576,175 4/1971 Gammill ..... 200/308 X 3,824,948 7/1974 Faloon ..... 200/308 X 3,845,736 11/1974 Golbeck et al. ..... 200/308 X

*Primary Examiner*—John W. Shepperd

*Assistant Examiner*—Renee S. Kidorf

*Attorney, Agent, or Firm*—Wenderoth, Lind & Ponack

[57] ABSTRACT

A display type push button having a push button body with a display window on the front end, a passage formed therein, and an elastic display plate laid in the passage in such a manner as to reciprocate along the passage to display the "on" and "off" states of a switch coupled to the push button, comprises a mechanism which makes the movement of the display plate larger than the stroke of the operating rod of the switch, whereby the area of the display plate appearing in the display window is large enough to clearly detect the operations of the switch.

3 Claims, 5 Drawing Figures

DISPLAY TYPE PUSH BUTTON

BACKGROUND OF THE INVENTION

This invention relates to the structure of a push button which can display the operations of a push button type switch, and more particularly to a display type push button which is suitable for a short-stroke push button type switch.

One example of the conventional structure for displaying the operation of a push button type switch is as shown in FIG. 1. The structure is so designed that one end of a display plate 2 is fastened to a switch casing 1, and the display plate 2 is moved in a through-hole 4*a* formed in a push button 4 secured to the operating rod 3 of the switch as the switch is operated. In other words, when the switch is turned on, the display plate 2 appears in the front window 4*b* of the push button 4.

The structure is disadvantageous in the following point: The movement of the display plate 2 is equal to the stroke of the operating rod 3. Accordingly, in the case of a small switch whose stroke is of the order of 2 mm, the area of the display plate 2 in the window 4*b* is so small that it is rather difficult to clearly recognize the display and accordingly the operation of the switch.

SUMMARY OF THE INVENTION

Accordingly, an object of this invention is to eliminate the above-described difficulty accompanying a conventional display type push button.

More specifically, an object of the invention is to provide a display type push button in which the area of the display plate appearing in the display window is large enough to recognize the operation of the switch clearly.

The foregoing object and other objects of the invention have been achieved by the provision of a display type push button which comprises a push button body having a display window on the front end thereof, a passage which is extended, in the form of a curve, from the rear end of the push button body to the window, and a display plate made of elastic material, the display plate being laid in the passage in such a manner as to reciprocate along the passage and having a stationary end portion which is secured to a switch body, so that, when a switch is turned on and off by operating the push button coupled thereto, the display plate displays the operations of the switch with the free end portion thereof going to and from the window; in which, according to the invention, the push button body has first and second protrusions which are protruded into the passage in the opposite directions and are spaced away from each other in the direction of movement of the display plate, and the display plate has first and second through-holes, in such a manner that, as the display plate reciprocates in the passage, at a first position the first protrusion is engaged with the first through-hole while the display plate is depressed by the second protrusion, and at a second position the second protrusion is engaged with the second through-hole while the display plate is depressed by the first protrusion so that the display plate is rocked with the stationary end portion as a fulcrum.

The nature, principle and utility of the invention will become more apparent from the following detailed description when read in conjunction with the accompanying drawing.

DETAILED DESCRIPTION OF THE INVENTION

Figure 1:
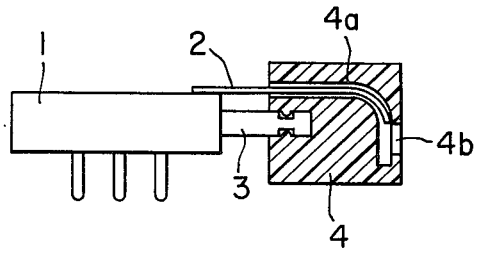
FIG. 1 (PRIOR ART)
FIG. 1 is an explanatory diagram showing a switch having a conventional structure for displaying the operations of the switch.
Figure 2:
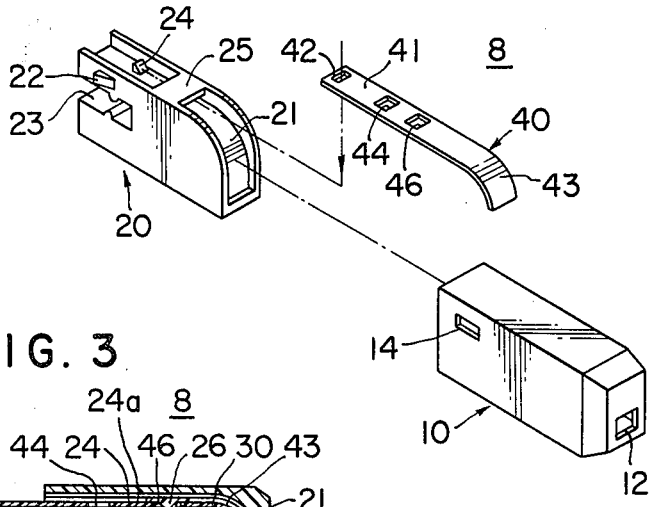
FIG. 2 is an exploded perspective view showing a display type push button according to this invention.
Figure 3:
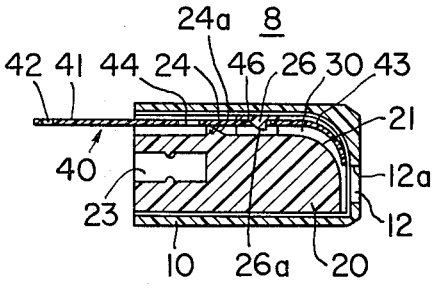
FIG. 3 is a sectional view of the push button in FIG. 2.

A display type push button according to this invention, as shown in FIGS. 2 and 3, comprises: a key top 10; a base body 20; and a display plate 40.

The key top 10 is hollow opening on the rear end, and has a window 12 on the front end. The base body 20 is inserted into the key top 10, thus forming a push button body.

The base body 20 has a groove 21 which is curved from the upper surface to the front end, a pawl 22 which is engaged with a hole 14 cut in the key top 10, and a recess 23 which receives the operating rod of the switch. Since the groove 21 is formed as described above, a passage 30 is provided between the base body 20 and the key top 10, which is extended, in the form of a curve, from the rear end of the push button body to the window 12. In this connection, it should be noted that a curve surface is formed in the inner wall of the key top 10 in such a manner as to extend along the groove 21 of the base body 20.

The display plate 40 is made of elastic material such as polyester. The display plate 40 has a stationary end portion 41 with an engaging hole 42, and a free end portion 43 which is extended along the passage 30. The display plate 40 is so designed as to be able to reciprocate along the passage 30, and has two through-holes 44 and 46 in the middle portion.

The groove 21 of the base body 20 has a protrusion 24 which is protruded into the passage 30. The base body 20 has a top plate 25 over the groove 21. The top plate 25 has a protrusion 26 on the lower surface, which is protruded into the passage 30 in the opposite direction to that of the protrusion 24. The first and second protrusions 24 and 26 are so positioned that they are apart from each other in the direction of movement of the display plate and are engageable with the through-holes 44 and 46 of the display plate 40. The protrusions 24 and 26 have slopes 24*a* and 26*a* so that they are disengaged from the through-holes 44 and 46, respectively, when the display plate 40 is moved. The distance between the through-holes 44 and 46 is larger than that between the protrusions 24 and 26. Accordingly, two protrusions 24 and 26 are not simultaneously engaged with the through-holes 44 and 46. Normally, the protrusion 26 is engaged with the through-hole 46, while the protrusion 24 is abutted against the lower surface of the display plate 40 and the top edge of the free end portion 43 is positioned near the upper frame of the window 12, as shown in FIG. 3.

The display type push button can be readily assembled as follows: The display plate 40 is laid under the top plate 25 of the base body 20, so that it is in the groove 21. Then, the base body 20 is inserted into the hollow key top 10 from behind until the pawl 22 is engaged with the hole 14 of the key top 10. Thus, the push button 8 has been assembled.

After the push button 8 has been assembled, the operating rod of a switch is inserted into the recess 23 of the base body 20, and the stationary end portion 41 of the display plate 40 is fastened to the switch body.

Figure 4:
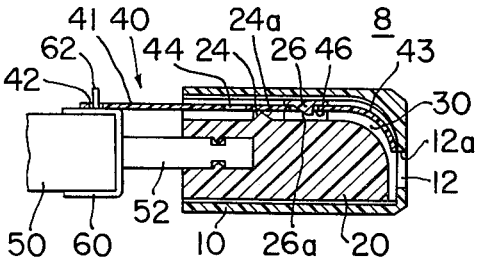
FIGS. 4 and 5 are explanatory diagrams for a description of the operation of the push button according to the invention.

The operation of the display type push button 8 will be described. FIG. 4 shows the push button 8 which has been coupled to the operating rod 52 of a switch 50. In FIG. 4, reference numeral 60 designates a mounting metal part with which the switch 50 is secured to an electrical device chassis or the like. The engaging hole 42 is put on a bent piece 62 formed on the upper surface of the mounting metal part, so that the stationary end portion 41 of the display plate 40 is secured to the switch body. The bent piece 62 has a head which is relatively wide so as to prevent the display plate 40 from readily coming off. It goes without saying that the stationary end portion 41 of the display plate 40 may be fastened to any other part such as a switch casing if it fixes the stationary end portion 41 with respect to the switch body.

In the case of FIG. 4, the switch 50 is in the "off" state, and the protrusion 26 is engaged with the through-hole 46, while the protrusion 24 depresses the lower surface of the display plate 40. Accordingly, the display plate 40 is maintained pushed upwardly in the passage 30, and the top edge of the free end portion 43 is positioned near the upper side 12*a* of the window 12. In this case, the display plate 40 does not appear in the window 12, and only the front end of the base body 20 appears in the window 12.

Figure 5:
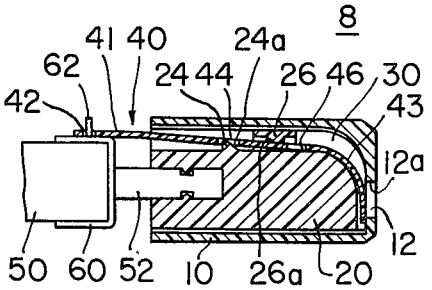

When, under this condition, the push button 8 is depressed against the elastic force of a spring (not shown) which is built in the switch 50 to restore the operating rod 52, the switch 50 is turned on as shown in FIG. 5. In other words, as the push button body is moved left in the figure, the protrusion 26 is disengaged from the through-hole 46 while its slope 26*a* being slid on the side of the through-hole 46, while the protrusion 24 which has pushed the display plate 40 upwardly is inserted into the through-hole 44, so that the display plate 40 is pushed downwardly by the protrusion 26. As a result, the free end portion 43 of the display plate 40 is moved as long as the distance which is the sum of the stroke of the operating rod 52 and the downward movement of the display plate by the protrusion 26, thus appearing in the window 12.

When the switch 50 is turned off by depressing the push button 8 again, the protrusion 24 is disengaged from the through-hole 44 while its slope 24*a* being slid on the side of the through-hole 44, while the protrusion 26 is engaged with the through-hole 46, as shown in FIG. 4. Accordingly, the operations of the switch 50 can be clearly displayed by making the color of the base body 20 different from that of the display plate 40.

In the above-described embodiment, the key top 10 and the base body 20 form the push button body; however, it should be noted that the invention is not limited thereto or thereby. For instance, the push button may be so modified that the push button body is divided into two parts along the passage 30; that is, the push button body is formed by joining these two parts together.

As is apparent from the above description, in the display type push button according to the invention, the display plate is swung with the stationary end portion as the fulcrum as the switch is operated, as a result of which, the movement of the free end portion of the display plate is larger than the stroke of the operating rod of the switch. Accordingly, a relatively large window may be provided for the display plate even if the switch is relatively small in stroke. Furthermore, as the display plate appears immediately behind the window, the operations of the switch can be clearly displayed. In addition, the number of components forming the push button is relatively small, and therefore the push button can be readily assembled. The push button can be coupled to a switch with ease.

What is claimed is:

1. A display type push button which comprises a push button body having a display window on the front end thereof, a passage which is extended, in the form of a curve, from the rear end of said push button body to said window, and a display plate made of elastic material, said display plate being laid in said passage in such a manner as to reciprocate along said passage and having a stationary end portion which is secured to a switch body, so that, when a switch is turned on and off by operating said push button coupled thereto, said display plate displays the operations of said switch with the free end portion thereof going to and from said window; in which said push button body has first and second protrusions which are protruded into said passage in the opposite directions and are spaced away from each other in the direction of movement of said display plate, and said display plate has first and second through-holes, in such a manner that, as said display plate reciprocates along said passage, at a first position said first protrusion is engaged with said first through-hole while said display plate is depressed by said second protrusion, and at a second position said second protrusion is engaged with said second through-hole while said display plate is depressed by said first protrusion so that said display plate is rocked with said stationary end portion as a fulcrum.

2. A display type push button as claimed in claim 1, in which said push button body is made up of a key top which is hollow opening in the rear end and has a display window, and a base body which is inserted into said hollow key top, and said passage is formed between said key top and said base body.

3. A display type push button as claimed in claim 1, in which said display plate is different in color from said push button body.

* * * * *